US005940023A

United States Patent [19]

Hintzke et al.

[11] Patent Number: 5,940,023

[45] Date of Patent: Aug. 17, 1999

[54] PARACHUTE APPARATUS HAVING ENHANCED RADAR REFLECTIVE CHARACTERISTICS

[75] Inventors: Steven M. Hintzke; William J. Everett, both of Vernon, Conn.

[73] Assignee: Pioneer Aerospace Corporation, South Windsor, Conn.

[21] Appl. No.: 09/069,579

[22] Filed: Apr. 29, 1998

[51] Int. Cl.[6] ..... H01Q 15/00

[52] U.S. Cl. ..... 342/5; 342/10

[58] Field of Search ..... 342/8, 10, 5; 244/142

[56] References Cited

U.S. PATENT DOCUMENTS

| | | | |
|---|---|---|---|
| D. 143,998 | 2/1946 | Shreeve et al. . | |
| 2,463,517 | 3/1949 | Chromak . | |
| 2,702,900 | 2/1955 | Matson, Jr. . | |
| 2,780,806 | 2/1957 | Van Alstyne . | |
| 2,793,362 | 5/1957 | Obera . | |
| 2,898,588 | 8/1959 | Graham . | |
| 2,912,687 | 11/1959 | Leonard . | |
| 3,041,604 | 6/1962 | Collis et al. . | |
| 3,296,617 | 1/1967 | Rogallo . | |
| 3,529,794 | 9/1970 | Stahler et al. | 244/142 |
| 3,604,001 | 9/1971 | Deal . | |
| 3,671,965 | 6/1972 | Rabenhovst et al. . | |
| 3,806,927 | 4/1974 | Lane, Jr. . | |
| 4,099,183 | 7/1978 | Wolff . | |
| 4,352,106 | 9/1982 | Firth . | |
| 4,546,983 | 10/1985 | Rosa . | |
| 4,673,934 | 6/1987 | Gentry et al. | 342/8 |
| 4,695,841 | 9/1987 | Billard | 342/8 |
| 4,724,436 | 2/1988 | Johansen et al. | 342/7 |
| 4,980,688 | 12/1990 | Dozier, Jr. | 342/9 |
| 4,990,918 | 2/1991 | Michelson et al. | 342/7 |
| 4,996,536 | 2/1991 | Rvoadhurst | 342/7 |
| 5,208,601 | 5/1993 | Hart | 342/7 |
| 5,285,213 | 2/1994 | Tusch | 342/8 |
| 5,454,742 | 10/1995 | Robertson . | |
| 5,457,472 | 10/1995 | Bjordal et al. | 342/8 |
| 5,530,445 | 6/1996 | Veazey | 342/8 |

*Primary Examiner*—Daniel T. Pihulic
*Attorney, Agent, or Firm*—Sperry, Zoda & Kane

[57] ABSTRACT

A parachute apparatus with enhanced radar reflective profile by inclusion of multiple panels preferably arranged angularly with respect to one another which are radar reflective in order to enhance the radar cross section of a deployed parachute canopy while not affecting the controlled airborne descent of a load attached thereto. The radar reflective member which increases the radar cross section is preferably secured to the suspension risers each of which are connected to multiple suspension lines extending between the canopy and the load securement location such that deployment of the canopy and the suspension members extending downward therefrom will also deploy the radar reflective member which is preferably of a flexible material including a metallic component in the form of panels arranged angularly with respect to one another to define preferably approximate 90 degree angles therebetween to in this manner be configured as a radar corner reflector to significantly enhance the ability to locate and identify the parachute apparatus during airborne descent.

24 Claims, 4 Drawing Sheets

PARACHUTE APPARATUS HAVING ENHANCED RADAR REFLECTIVE CHARACTERISTICS

BACKGROUND OF THE INVENTION

1. Field of the Invention

It is sometimes desirable to enhance the radar cross section of an object descending airborne under a parachute for various purposes. Examples of such purposes may be the tracking of the certain loads such as capsules returning from space or emergency return vehicles returning from manned space platforms orbiting the earth.

There are many other similar applications for such radar enhancements such as decoy devices intended to distract hostile fire or to give the impression of large numbers of aerial vehicles such as attack aircraft in order to generate misinformation. Such enhanced cross sections can be accomplished by many means, however, the apparatus of the present invention has been shown to be particularly advantageous over other designs.

It is important when enhancing the radar profile of a parachute load configuration that weight be minimized and that no interference with the parachute deployment or descent characteristics occur. In prior art designs enhanced radar reflective materials have been attached to the canopy of parachutes, however this has been shown to yield inconsistent results due to the variations in configuration and deployment characteristics of the canopies when the parachute is inflated. Such configurations result in a return signal with wide variations in intensity which makes it difficult to track specific targets when needed. The present invention provides a means for easily deploying of a relatively highly reflective radar device including a set of radar profile panels which do not interfere with the operation of the parachute during deployment or descent and which can easily be packed along with a parachute canopy prior to deployment and can easily be deployed therewith.

2. Description of the Prior Art

The parachute apparatus with enhanced radar profile of the present invention is a distinct improvement over many prior art designs such as those shown in U.S. Pat. No. Des. 143,998 patented Feb. 26, 1946 to K. E. Shreeve et al on a "Weather Observation Balloon Radar Corner Reflector Target"; and U.S. Pat. No. 2,463,517 patented Mar. 8, 1949 to L. Chromak on an "Airborne Corner Reflector"; and U.S. Pat. No. 2,702,900 patented Feb. 22, 1955 to L. E. Matson, Jr. and assigned to the United States of America as represented by the Secretary of the Army on a "Corner Reflector"; and U.S. Pat. No. 2,780,806 patented Feb. 5, 1957 to A. G. Van Alstyne and assigned to Gilfillan Bros. Inc. on a "Radar Reflector For Aircraft"; and U.S. Pat. No. 2,793,362 patented May 21, 1957 to S. Oberg and assigned to Svenska Aktiebolaget Gasacumulator on a "Reflector System Intended For Radar Purposes"; and U.S. Pat. No. 2,898,588 patented Aug. 4, 1959 to C. L. Graham and assigned to Northrop Corporation on an "Attack Deviation Device"; and U.S. Pat. No. 2,912,687 patented Nov. 10, 1959 to N. N. Leonard on a "Foldable Radar Target"; and U.S. Pat. No. 3,041,604 patented Jun. 26, 1962 to R. T. H. Collis et al and assigned to The Decca Record Company Limited on a "Corner Reflector Formed Of Taut Flat Reflecting Elements With Resilient Peripheral Tension Frames"; and U.S. Pat. No. 3,296,617 patented Jan. 3, 1967 to F. M. Rogallo on a "Target Kite"; and U.S. Pat. No. 3,604,001 patented Sep. 7, 1971 to R. Deal and assigned to The United States of American as represented by the Secretary of the Air Force on a "Method And Apparatus For Locating Cooperative Personnel In Densely Foliated Areas"; and U.S. Pat. No. 3,806,927 patented Apr. 23, 1974 to Noel W. Lane, Jr. and assigned to Whittaker Corporation on a "Radar Reflector Buoy"; and U.S. Pat. No. 3,671,965 patented Jun. 20, 1972 to D. Rabenhorse et al and assigned to The United States of America as represented by the Secretary of the Navy on a "Rapid Deployment Corner Reflector"; and U.S. Pat. No. 4,099,183 patented Jul. 4, 1978 to H. Wolff and assigned to The United States of America as represented by the Secretary of the Navy on a "Self-Destroying Location Marking Means"; and U.S. Pat. No. 4,352,106 patented Sep. 28, 1982 to J. Firth on "Radar Reflectors"; and U.S. Pat. No. 4,546,983 patented Oct. 15, 1985 to S. Rosa and assigned to TVI Energy Corporation on a "Multi-Spectral Target"; and U.S. Pat. No. 4,673,934 patented Jun. 16, 1987 to G. Gentry et al and assigned to Gabb Corporation on an "Inflatable Radar Reflector"; and U.S. Pat. No. 4,695,841 patented Sep. 22, 1987 to A. Billard and assigned to Societe E. Lacrois on a "Method For Deceiving Active Electromagnetic Detectors And Corresponding Decoys"; and U.S. Pat. No. 4,724,436 patented Feb. 9, 1988 to E. Johansen et al and assigned to Environmental Research Institute of Michigan on a "Depolarizing Radar Corner Reflector"; and U.S. Pat. No. 4,980,688 patented Dec. 25, 1990 to J. Dozier, Jr. and assigned to The United States of Americas as represented by the Secretary of the Navy on a "Regenerator"; and U.S. Pat. No. 4,990,918 patented Feb. 5, 1991 to D. Michelson et al and assigned to the University of British Colombia on a "Radar Reflector To Enhance Radar Detection"; and U.S. Pat. No. 4,996,536 patented Feb. 26, 1991 to J. Broadhurst and assigned to Woodville Polymer Engineering Limited on a "Radar Reflectors"; and U.S. Pat. No. 5,208,601 patented May 4, 1993 to G. Hart and assigned to The United States of America as represented by the Secretary of the Navy on an "All-Weather Precision Landing System For Aircraft In Remote Areas"; and U.S. Pat. No. 5,285,213 patented Feb. 8, 1994 to K. Tusch and assigned to Colebrand Limited on an "Electromagnetic Radiation Reflector"; and U.S. Pat. No. 5,454,742 patented Oct. 3, 1995 to J. Robertson on a "Radar Reflective Buoy And Method Of Manufacturing The Same"; and U.S. Pat. No. 5,457,472 patented Oct. 10, 1995 to O. Bjordal et al and assigned to Baco Industrier A/S on a "Corner Reflector For Use In A Radar Balloon"; and U.S. Pat. No. 5,530,445 patented Jun. 25, 1996 to S. Veazey and assigned to S.E. Ventures, Inc. on "Parafoil-Borne Distress Signals".

SUMMARY OF THE INVENTION

The parachute apparatus of the present invention provides enhanced radar reflective characteristics while at the same time allowing for accurate and controlled airborne descent for loads suspended therefrom. The configuration of the parachute includes a canopy which is deployable for facilitating controlled airborne descent. Also included is a plurality of suspension members extending downwardly and inwardly from the canopy while converging inwardly toward one another to define an area of confluence therebelow to facilitate supporting of a load from the canopy. A load securement location is defined on the suspension members within the area of confluence thereof which is detachably securable with respect to a load as desired selectively in order to allow support thereof by the suspension members and the canopy for facilitating control of airborne descent.

A radar reflective member is also included which is at least partially radar reflective and is secured to the suspension members in such a manner as to extend therebetween.

This enhanced radar reflective member preferably includes multiple panel members attached with respect to one another and with respect to the suspension members in order to form the radar reflective member.

In the preferred configuration, the panels of the radar reflective member are made of a flexible material which allows for packing thereof along with the canopy prior to deployment and allows for deployment of the radar reflective member simultaneously with the canopy at the time of use.

In the preferred configuration of the suspension members of the parachute apparatus, they define two specific sections, firstly, a plurality of suspension lines which are attached directly to the canopy and extend downwardly therefrom. Secondly, a plurality of suspension risers are attached to these suspension lines and extend downwardly therefrom to the area of confluence. In the preferred normal configuration a number of suspension lines will be twenty and the number of suspension risers will be four. In this manner each individual suspension riser will be attached with respect to five of said suspension lines. Normally each of these five suspension lines will be adjacent to one another and will all be attached as a group into one particular suspension riser. Thus, the four suspension risers will be connected to each group of five of the suspension lines which total twenty in number. It should be noted that each suspension line will preferably only be connected to a single riser. The number of suspension lines can vary from the specific number used in this example, namely 20. Any number of suspension lines can be used, but it is preferable that the total number be divisible by four so that the 90 degree relative orientation of the vertical panels can be achieved. Similarly, the number of risers included can be any given number but it is preferable that such number be divisible by four. Four, however, is the optimum preferred number of risers as described in the example above.

In a preferred configuration of the present invention, the panels of the radar reflective member when attached to the suspension members can be attached to the suspension lines or the suspension risers depending upon the positioning and desired deployment thereof and dependent upon the configuration thereof.

It is preferred that the individual panel members are angularly oriented with respect to one another and preferably at approximately 90 degrees with respect to one another to enhance the radar reflective characteristics thereof. This angular orientation can cause double or multiple reflection of radar thereby enhancing the radar cross section thereof. Each of these panel members preferably includes a metallic component which can be a coating, a weaving or any other means of extending the metallic component across the expanse of the panel in order to enhance the radar reflective characteristics thereof. The panel members may include a first panel member secured to oppositely positioned suspension members and extending therefrom as well as a second panel member secured to other oppositely positioned of said suspension members and extending therebetween in angular or preferably perpendicular orientation with respect to the first panel member. Preferably the first panel member and the second panel member in this configuration will intersect along an axis of intersection therebetween where they will be approximately perpendicular with respect to one another. The first panel member and the second panel member can be secured to suspension lines or suspension risers and will be useful in both configurations. It should be appreciated that greater pressure is exerted laterally to facilitate deployment of the panels when they are secured to the suspension risers since each riser is connected in the normal configuration to five suspension lines and thereby exert a greater lateral force to facilitate deployment thereof than in the configuration wherein each panel is secured only to a single suspension line.

In another embodiment of the present invention a third panel member can be included which is generally extendable horizontally and angularly with respect to the first and second panels. This third panel also is preferably secured with respect to the suspension members as desired. In most of the preferred configurations utilizing such a third panel it will be oriented approximately perpendicularly with respect to both the first panel and the second panel which themselves are approximately perpendicular with respect to one another which in this manner generally defines a radar corner reflector positioned between the suspension members of the parachute when deployed.

This third panel member can be circular in shape which is the preferred configuration when it is attached to the suspension lines or it can be square in shape which is the preferred configuration when it is attached to the suspension riser members.

The material of the panels of the radar reflective member of the present invention can be of any flexible design. It can be a woven or non-woven fabric or it can be a simple film. It is only necessary that the material be flexible such that it can be packed prior to deployment and capable of being fully deployed along with the canopy. It is also important that a metallic electrically conductive component extend across the expanse of the panel to enhance the radar reflective profile or characteristics thereof. This metallic member can be a coating or a weave of metallic filaments or fibers or can be a laminated or otherwise attached separate layer which extends laterally horizontally and vertically with the panels. Examples of such materials include aluminized mylar with scrim and metal coated reinforced paper material or silvered flexible fabric or other similar material. Films can also be used but normally they must be reinforced such as with scrim and metal coated such as being aluminized.

It is an object of the present invention to provide a parachute apparatus having enhanced radar reflective characteristics for providing controlled airborne descent for a load attached thereto wherein rapid radar detection of airborne descending parachutes is enhanced.

It is an object of the present invention to provide a parachute apparatus having enhanced radar reflective characteristics for providing controlled airborne descent for a load attached thereto wherein interference with the packing and deployment of a parachute canopy is prevented.

It is an object of the present invention to provide a parachute apparatus having enhanced radar reflective characteristics for providing controlled airborne descent for a load attached thereto wherein additional cost to the basic parachute design is minimized.

It is an object of the present invention to provide a parachute apparatus having enhanced radar reflective characteristics for providing controlled airborne descent for a load attached thereto wherein maintenance requirements are minimized.

It is an object of the present invention to provide a parachute apparatus having enhanced radar reflective characteristics for providing controlled airborne descent for a load attached thereto wherein very little weight is added to the basic parachute design.

It is an object of the present invention to provide a parachute apparatus having enhanced radar reflective characteristics for providing controlled airborne descent for a load attached thereto wherein readily available and inexpensive materials are used for the added radar reflective panels.

It is an object of the present invention to provide a parachute apparatus having enhanced radar reflective characteristics for providing controlled airborne descent for a load attached thereto wherein the radar reflective panels can be held taut by the inflated parachute suspension members upon deployment of the canopy thereof.

It is an object of the present invention to provide a parachute apparatus having enhanced radar reflective characteristics for providing controlled airborne descent for a load attached thereto wherein high radar cross section is generated by use of double and multiple reflections of radar reflective panels oriented at angles of approximately 90 degrees with respect to one another.

It is an object of the present invention to provide a parachute apparatus having enhanced radar reflective characteristics for providing controlled airborne descent for a load attached thereto wherein positioning of the panels between suspension risers is used in order to achieve greater tension laterally for deployment or the panels than is possible by securement of the panels with respect to suspension lines.

It is an object of the present invention to provide a parachute apparatus having enhanced radar reflective characteristics for providing controlled airborne descent for a load attached thereto wherein the panels may be formed of metal coated films, woven fabrics, unwoven fabrics, spun bonded fabrics or any other material having an enhanced radar reflective characteristic.

It is an object of the present invention to provide a parachute apparatus having enhanced radar reflective characteristics for providing controlled airborne descent for a load attached thereto wherein the radar reflective panels are capable of being stitched or otherwise secured with respect to the suspension members.

It is an object of the present invention to provide a parachute apparatus having enhanced radar reflective characteristics for providing controlled airborne descent for a load attached thereto wherein the panels members can be bonded or glued with adhesives with respect to the parachute suspension members.

It is an object of the present invention to provide a parachute apparatus having enhanced radar reflective characteristics for providing controlled airborne descent for a load attached thereto wherein the radar deployment panels do not appreciably affect the aerodynamic characteristics of the other portion of the parachute design.

It is an object of the present invention to provide a parachute apparatus having enhanced radar reflective characteristics for providing controlled airborne descent for a load attached thereto wherein multiple vertically extending panels and one horizontally extending panel can be utilized to form a radar corner reflector secured between the suspension members of the parachute.

It is an object of the present invention to provide a parachute apparatus having enhanced radar reflective characteristics for providing controlled airborne descent for a load attached thereto wherein use with a gliding wing ram air-type parachute such as a para-foil is possible despite the significantly different aerodynamic characteristics thereof when compared to a conventional parachute design.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
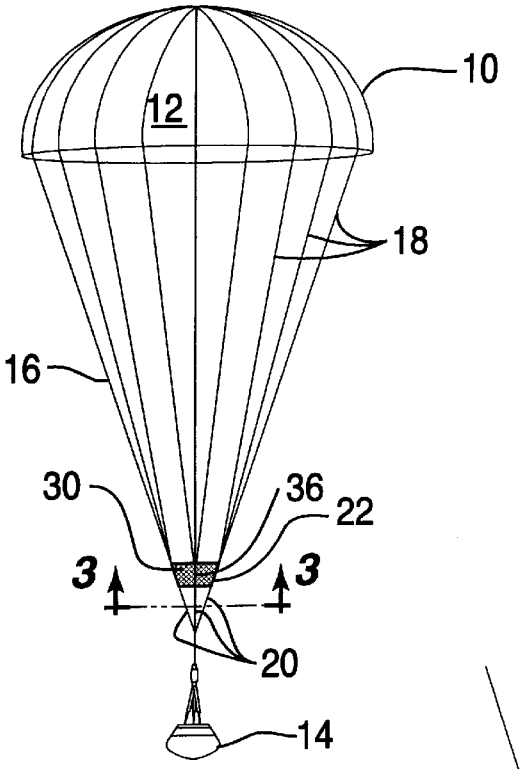
FIG. 1 is a front plan view of an embodiment of the parachute apparatus of the present invention showing the radar reflective member and the load attached thereto.
Figure 4:
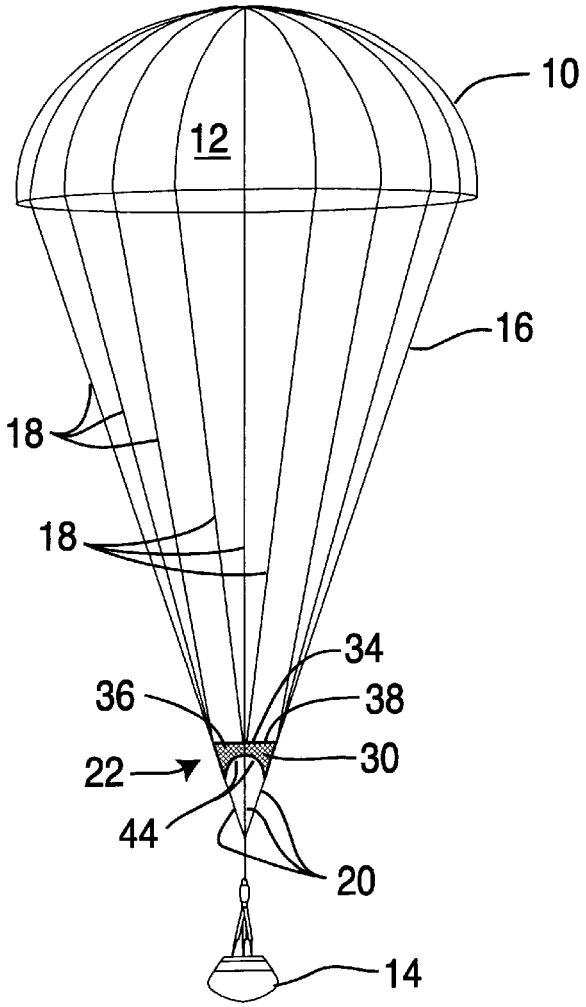
FIG. 4 is a front plan view of an alternative embodiment of the apparatus of the present invention.
Figure 8:
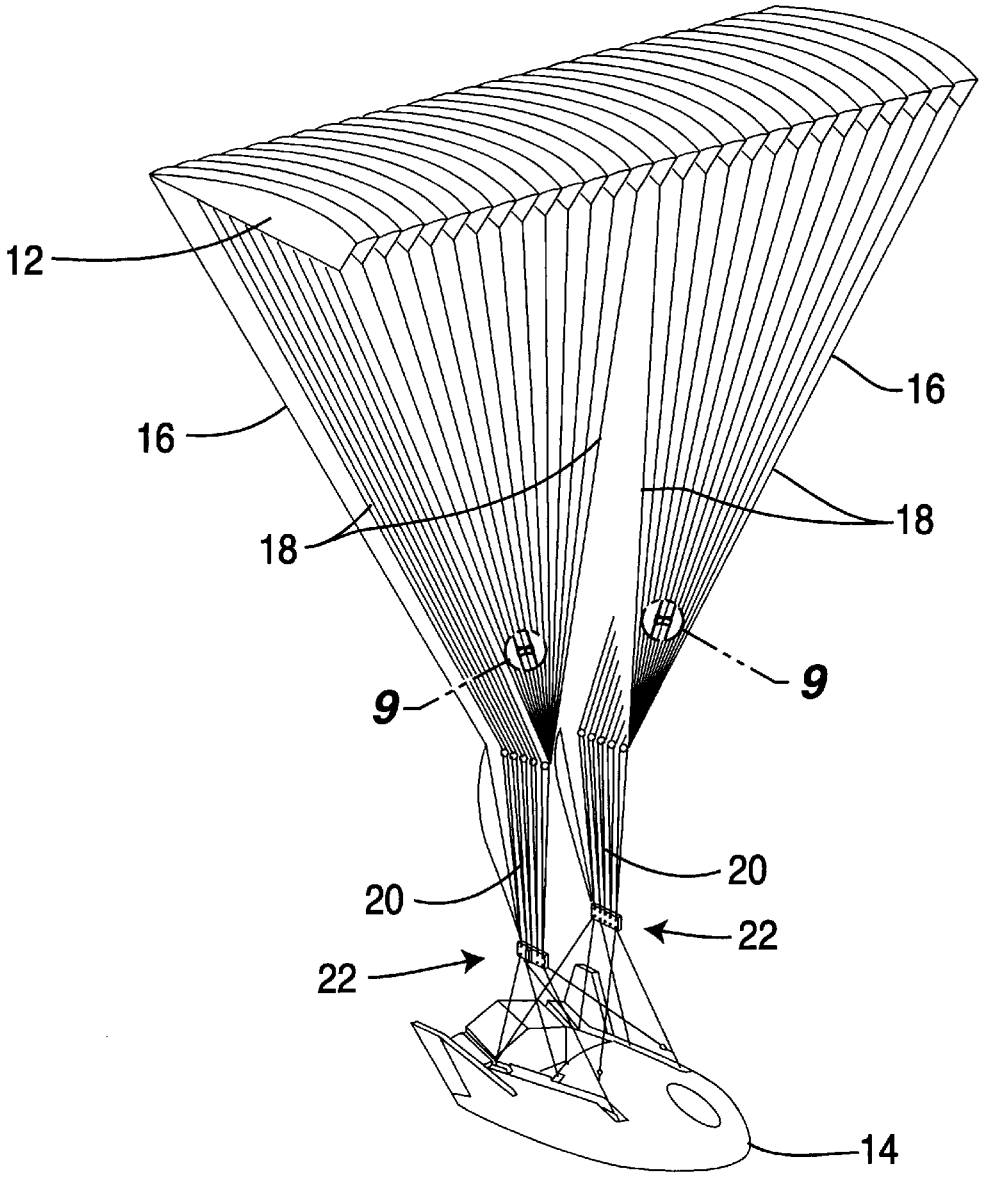
FIG. 8 is another alternative embodiment of the present invention showing the radar reflective member secured to a ram air type gliding wing parachute.
Figure 9:
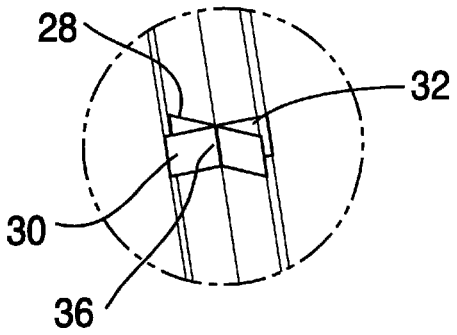
FIG. 9 is an exploded view of the radar reflective member shown in the embodiment in FIG. 8.

The present invention provides an improved apparatus for a parachute which has enhanced radar reflective characteristics while at the same time providing conventionally controlled airborne descent for a load detachably secured thereto. The apparatus of the parachute 10 includes a canopy 12 which can take the form of a more conventional round canopy as shown in FIGS. 1 and 4 or can comprise a ram air canopy 46 as shown in FIG. 8. The radar reflector member 26 of the present invention works well with either canopy design, that is, the circular canopy 12 or the gliding wing canopy 46.

The canopy 12 is designed such that when deployed a plurality of suspension members 16 will extend downwardly and inwardly therefrom to an area of confluence 22. A load 14 is detachably securable with respect to the suspension members 16 within the area of confluence 22 at a location defined as the load securement location 24.

The suspension members 16 preferably include two separate sections, an upper section or plurality of suspension lines 18 which are attached directly to the canopy 12 which then extend downwardly and inwardly therefrom toward the area of confluence 22. A plurality of risers 20 are secured to the suspension lines 18 and extend downwardly therefrom into the area of confluence 22 to define the load securement location 24 therein.

In the preferred configuration as shown in FIGS. 1 and 4 of the present invention, there will be twenty such suspension lines 18 and four such suspension risers 20. In practice any number of suspensions lines 18 and risers 20 can be included however, 20 suspension lines and 4 risers appear at the present time to be the preferred configuration. It is preferred that the number of suspension lines 18 be greater than the number of suspension risers 20. With this configuration the risers will provide a stable mounting location for the radar reflective member which is significantly more desirable than securement with respect to the suspension lines. Each of the risers 20 will be attached to two or more of the suspension lines 18 in all configurations. Each suspension riser 20 will be connected with respect to five suspension lines 18. Those five suspension lines 18 connected to an individual suspension riser 20 will normally be positioned immediately adjacent to one another. Thus, the forces exerted on the suspension lines 18 will be approximately 20% of the forces exerted upon each of the suspension risers 20 since each riser 20 is connected to five suspension lines 18.

In order to enhance the radar reflective characteristics of the apparatus of the present invention a radar reflective member 26 is preferably positioned attached to the suspension members 16. The radar reflective member preferably includes a plurality of panel members 28 which are flexible in order to facilitate the packing thereof along with the canopy prior to deployment and to facilitate deployment thereof immediately after deployment of the canopy 12. Also the panel members 28 preferably include a metallic component therein which further enhances the radar cross section thereof.

The panel members 28 preferably include a first panel member 30 secured to opposite suspension members 16 and extending therebetween upon deployment of the parachute 10 in such a manner as to define a vertically extending panel positioned between the oppositely located suspension members 16. In a similar manner a second panel member 32 is secured to other suspension members 16 such that when the canopy 12 is deployed the second panel member 32 will be deployed. In the preferred configuration first panel member 30 and second panel member 32 intersect along an axis of intersection 36 wherein they are approximately perpendicularly oriented with respect to one another to enhance the radar cross section thereof by double or multiple reflection made possible by the perpendicular or acute angle therebetween.

Figure 2:
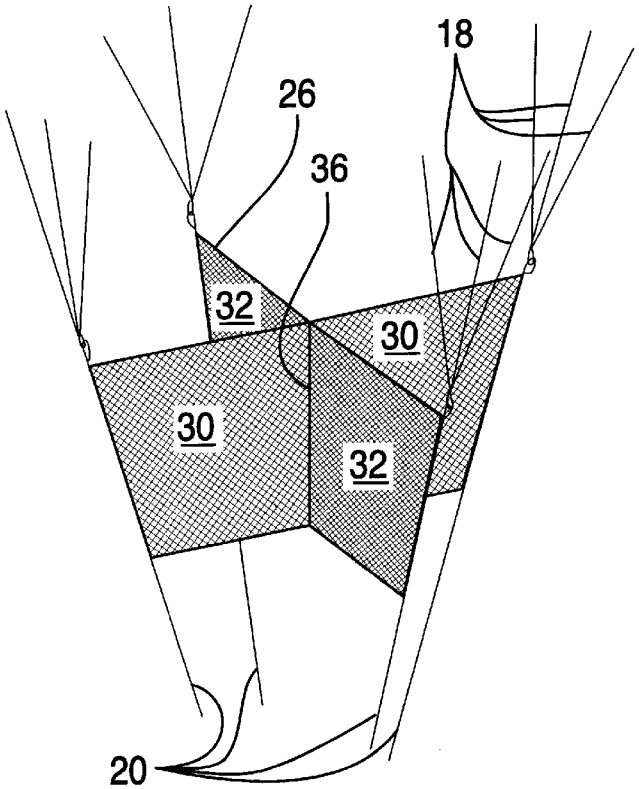
FIG. 2 is a perspective enlarged view of the radar reflective member shown in FIG. 1.
Figure 5:
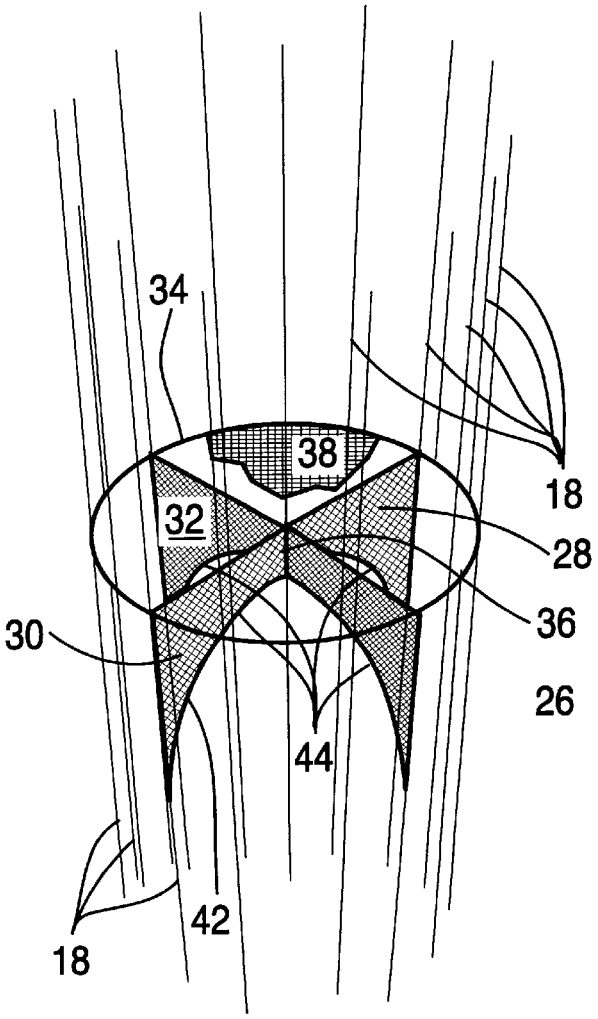
FIG. 5 is an exploded view of the radar corner reflector of the embodiment shown in FIG. 4.
Figure 6:
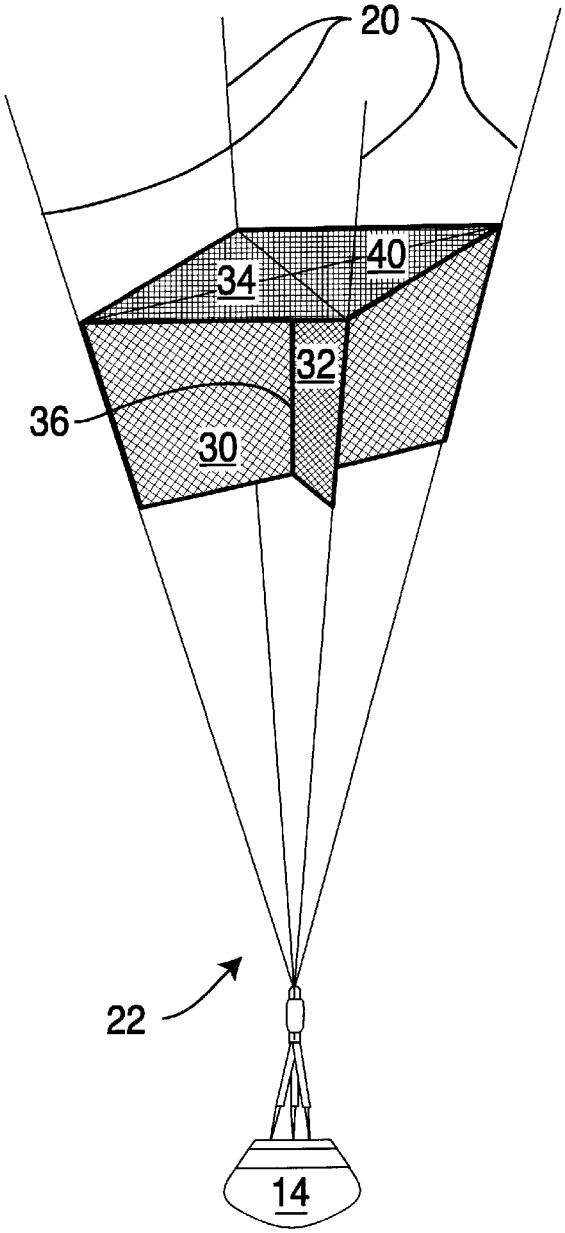
FIG. 6 is an exploded view of an alternative configuration for the radar reflective member of the present invention.
Figure 7:
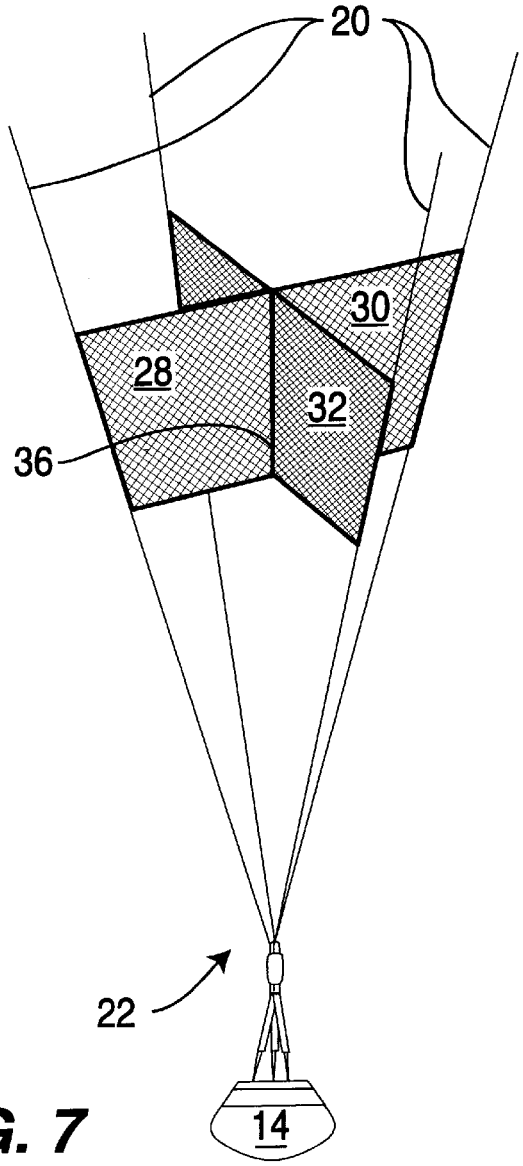
FIG. 7 is another alternative configuration of the radar reflective member of the present invention.

In the configuration shown in FIGS. 1, 2 and 7 the first and second panel members 30 and 32 will provide significant radar cross section for enhancement of the radar reflective characteristics of the parachute. Further radar reflectance can be achieved by the usage of a third panel member 34 as shown in FIGS. 4, 5 and 6 of the present invention. Preferably this third panel member 34 will extend horizontally above the vertically extending first and second panels 30 and 32 in such a manner as to form a right angle therewith. That is, the first and second panel members 30 and 32 will be perpendicular with respect to one another and the third panel member 34 will extend perpendicularly with respect to both the first panel member 30 and the second panel member 32 to in this manner define a radar corner reflector automatically deployable between the suspension members of a parachute for increasing the radar tracking characteristics thereof.

This third panel member 34 can be of a circular configuration as shown in FIGS. 4 and 5 which is the preferred configuration when the third panel member 34 is attached with respect to the suspension lines 18. In a situation where the third panel member 34 is secured with respect to the suspension risers 24 the preferred shape of the third panel member is the square panel member 40. This square panel member will extend between the normal embodiment of the suspension risers 20 which is four such risers. The circular third panel member 38 will achieve the circular configuration due to the fact that it is secured with respect to each of what is normally twenty individual suspension lines 18. Both of these configurations significantly enhances the radar reflective characteristics by forming the three dimensional corner with the first and second panel members 30 and 32.

Figure 3:
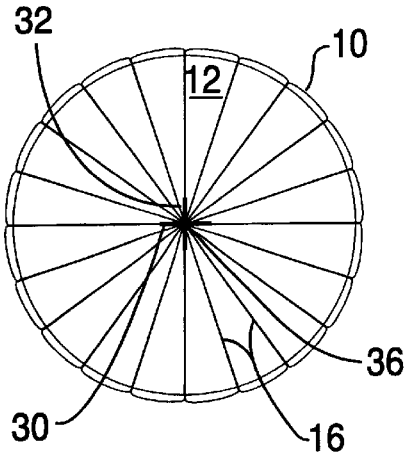
FIG. 3 is a bottom plan view of the parachute configuration of FIG. 1.

In the configuration shown in FIGS. 2 and 3 the first and second panels can be made significantly more taut by forming the lower edge of the first and second panel members 30 and 32 in an arcuate configuration 42. Preferably this arcuate configuration 42 is catenary shaped. Catenary shape is defined to be a portion of an ellipse which has been found to be the best shape for maintaining the vertically extending first and second panels 30 and 32 in a fully deployed flat expansive position responsive to the lateral pressure exerted thereon by attachment to the suspension members 16 surrounding the panels. The catenary curve is defined mathematically as the curve formed by a perfectly flexible inextensible infinitely slender chord suspended only at its ends. This is the preferred shape for the lower edge of the panel members 30 and 32 in order to maintain full taut deployment thereof.

Any of the configurations of the design of the present invention can be utilized for radar reflection by being positioned between the suspension lines normally twenty in number or between the suspension risers normally four in number. The risers generally exert a greater lateral force and in certain configurations that is desired. In other configurations it is preferable that the force be more equally distributed and in such configurations the attachment of the radar reflective members is made with respective to the suspension lines but in either case the radar reflective member is always secured with respect to the suspension members and is deployable along with the canopy.

The packing and deployment of the radar reflective member of the present invention is an important characteristic of this design. As such, the panel members 28 themselves must be of a flexible material. Many such materials can be utilized such as woven or non-woven fabrics, films, etc. These materials preferably will have a metallic component for enhancing radar reflection thereof and such metallic component can be a lamination, a woven fiber or a coating or any other manner for placing the metallic component across the expanse of the panel. A scrim reinforced aluminized film has been found to be useful along with various metalized fabrics and films. It is only important that the radar reflective characteristics of the panel be enhanced by whatever metallic component is utilized. It is also important to appreciate that a metallic component is not a required element of the apparatus of the radar reflective panels of the present invention but there must be some electrically conductive component extending across the expanse of the panels. In designing the panels the use of a metallic component has been found to be the best manner of including such an electrically conductive component. Weight is a very important characteristic in any parachute configuration. As such, the weight of these radar reflective panels must be maintained at a minimum and in some configurations only the first and second panels will be utilized to decrease weight which is slightly sacrifice by decreasing the radar cross section. In other configurations the added weight can be accepted in the overall design as a tradeoff for the increase in radar reflective profile.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A parachute having enhanced radar reflective characteristics and providing controlled airborne descent for a load comprising:

A. a canopy means for facilitating controlled airborne descent;

B. a plurality of suspension members extending downwardly and inwardly from said canopy means and converging inwardly toward one another to define an area of confluence below said canopy means for supporting of a load therebelow, said plurality of said suspension members including:

(1) a plurality of suspension lines attached to said canopy means and extending downwardly therefrom; and (2) a plurality of suspension risers each being attached to at least two of said suspension lines and extending downwardly therefrom to said area of confluence, each of said suspension lines being attached to only one of said suspension risers;

C. a load securement location defined on said suspension risers adjacent said area of confluence thereof being detachably securable to a load for allowing support thereof by said suspension members and said canopy means to facilitate controlled airborne descent thereof; and D. a radar reflective member being at least partially radar reflective and attached to said suspension risers and extending therebetween, said enhanced radar reflective member including a plurality of panel members attached with respect to one another and attached to said suspension risers in order to form a radar reflective member with enhanced radar reflective characteristics.

2. A parachute having enhanced radar reflective characteristics and providing controlled airborne descent for a load as defined in claim 1 wherein said radar reflective member is made of a flexible material to facilitate packing thereof with said canopy means and said suspension members and to facilitate deployment thereof responsive to deployment of said canopy means.

3. A parachute having enhanced radar reflective characteristics and providing controlled airborne descent for a load as defined in claim 1 wherein said plurality of panel members are secured to said suspension risers in an angular orientation with respect to one another for enhancing radar reflection therefrom.

4. A parachute having enhanced radar reflective characteristics and providing controlled airborne descent for a load as defined in claim 1 wherein at least some of said plurality of panel members are secured to said suspension risers in a perpendicular orientation with respect to other of said panel members for enhancing radar reflection therefrom.

5. A parachute having enhanced radar reflective characteristics and providing controlled airborne descent for a load as defined in claim 1 wherein said radar reflective member includes:

A. a first panel member secured to oppositely positioned of said suspension risers and extending therebetween; and B. a second panel member secured to oppositely positioned of said suspension risers and extending therebetween in perpendicular orientation with respect to said first panel member.

6. A parachute having enhanced radar reflective characteristics and providing controlled airborne descent for a load as defined in claim 5 wherein said first panel member and said second panel member intersect to form an axis of intersection therebetween with said first panel member and said second panel member extending outwardly from said axis of intersection in perpendicular orientation with respect to each other.

7. A parachute having enhanced radar reflective characteristics and providing controlled airborne descent for a load as defined in claim 5 wherein said first panel member and said second panel member extend vertically and are perpendicular with respect to one another extending between said suspension risers.

8. A parachute having enhanced radar reflective characteristics and providing controlled airborne descent for a load as defined in claim 5 wherein said radar reflective member further includes a third panel member extending generally horizontally and angularly with respect to said first panel member and said second panel member.

9. A parachute having enhanced radar reflective characteristics and providing controlled airborne descent for a load as defined in claim 8 wherein said third panel member is oriented perpendicularly with respect to said first panel member and also perpendicularly with respect to said second panel member to form a radar reflective corner therewith.

10. A parachute having enhanced radar reflective characteristics and providing controlled airborne descent for a load as defined in claim 9 wherein said third panel member is generally circular in shape.

11. A parachute having enhanced radar reflective characteristics and providing controlled airborne descent for a load as defined in claim 9 wherein said third panel member is attached to said suspension risers therearound to facilitating deployment thereof.

12. A parachute having enhanced radar reflective characteristics and providing controlled airborne descent for a load as defined in claim 9 wherein said third panel member is generally square in shape and attached at the corners thereof with respect to said suspension risers to facilitate deployment thereof.

13. A parachute having enhanced radar reflective characteristics and providing controlled airborne descent for a load as defined in claim 1 wherein said radar reflective member extending between said suspension risers includes a flexible metallic material component therein to enhance radar reflection thereof.

14. A parachute having enhanced radar reflective characteristics and providing controlled airborne descent for a load as defined in claim 1 wherein said panel members define arcuate panel edges to facilitate deployment of said panel members extending between said suspension risers responsive to deployment of said canopy means.

15. A parachute having enhanced radar reflective characteristics and providing controlled airborne descent for a load as defined in claim 14 wherein said arcuate panel edges are each generally in the shape of a partial elliptical curve to facilitate equalized exertion of laterally directed forces thereon to enhance deployment thereof in position extending between said suspension risers.

16. A parachute having enhanced radar reflective characteristics and providing controlled airborne descent for a load as defined in claim 14 wherein said arcuate panel edges are each in the shape of a catenary curve to facilitate equalized exertion of laterally directed forces thereon to enhance deployment thereof in position extending between said suspension risers.

17. A parachute having enhanced radar reflective characteristics and providing controlled airborne descent for a load as defined in claim 1 wherein said panel members define arcuate lower panel edges to facilitate equalized exertion of laterally directed forces thereon to enhance deployment thereof in position extending between said suspension risers.

18. A parachute having enhanced radar reflective characteristics and providing controlled airborne descent for a load as defined in claim 1 wherein said radar reflective member is secured to said suspension risers at a position closer to said load securement location and said area of confluence than to said canopy in order to facilitate full deployment of said canopy prior to full deployment of said radar reflective member during deployment of said parachute.

19. A parachute having enhanced radar reflective characteristics and providing controlled airborne descent for a load as defined in claim 1 wherein said suspension members include at least four of said suspension risers each being secured to a plurality of said suspension lines.

20. A parachute having enhanced radar reflective characteristics and providing controlled airborne descent for a load as defined in claim 19 wherein said suspension members include twenty of said suspension lines with each one of said suspension risers being secured to five of said suspension lines.

21. A parachute having enhanced radar reflective characteristics and providing controlled airborne descent for a load as defined in claim 20 wherein all of each group of five of said suspension lines attached to a specific one of said suspension risers are secured to said canopy adjacent to one another.

22. A parachute having enhanced radar reflective characteristics and providing controlled airborne descent for a load as defined in claim 13 wherein said radar reflective member extending between said suspension risers includes a flexible metallic mesh therein to enhance radar reflection thereof.

23. A parachute having enhanced radar reflective characteristics and providing controlled airborne descent for a load comprising:

A. a canopy means for facilitating controlled airborne descent;

B. a plurality of suspension members extending downwardly and inwardly from said canopy means and converging inwardly toward one another to define an area of confluence below said canopy means for supporting of a load therebelow, said plurality of said suspension members including:

(1) a plurality of suspension lines attached to said canopy means and extending downwardly therefrom; and (2) a plurality of suspension risers each being attached to at least two of said suspension lines and extending downwardly therefrom to said area of confluence, each of said suspension lines being attached to only one of said suspension risers;

C. a load securement location defined on said suspension risers adjacent said area of confluence thereof being detachably securable to a load for allowing support thereof by said suspension members and said canopy means to facilitate controlled airborne descent thereof;

D. a radar reflective member made of a flexible material to facilitate packing thereof with said canopy means and said suspension members and to facilitate deployment thereof responsive to deployment of said canopy means, said radar reflective member being at least partially radar reflective and attached to said suspension risers and extending therebetween, said enhanced radar reflective member including a plurality of panel members attached with respect to one another and attached to said suspension risers in order to form a radar reflective member with enhanced radar reflective characteristics, said panel member being secured to said suspension risers in a perpendicular angular orientation with respect to one another for enhancing radar reflection therefrom, said panel members defining arcuate panel edges to facilitate deployment of said panel members extending between said suspension risers responsive to deployment of said canopy means, said radar reflective member being secured to said suspension risers at a position closer to said load securement location and said area of confluence than to said canopy in order to facilitate full deployment of said canopy prior to full deployment of said radar reflective member during deployment of said parachute, said radar reflective member including:

(1) a first panel member secured to oppositely positioned of said suspension risers and extending vertically therebetween; and (2) a second panel member secured to oppositely positioned of said suspension risers and extending vertically therebetween in perpendicular orientation with respect to said first panel member, said first panel member and said second panel member intersecting to form an axis of intersection therebetween with said first panel member and said second panel member extending outwardly from said axis of intersection in perpendicular orientation with respect to each other.

24. A parachute having enhanced radar reflective characteristics and providing controlled airborne descent for a load comprising:

A. a canopy means for facilitating controlled airborne descent;

B. a plurality of suspension members extending downwardly and inwardly from said canopy means and converging inwardly toward one another to define an area of confluence below said canopy means for supporting of a load therebelow, said plurality of said suspension members including:

(1) a twenty suspension lines attached to said canopy means and extending downwardly therefrom; and (2) a four suspension risers each being attached to five of said suspension lines and extending downwardly therefrom to said area of confluence, each of said suspension lines being attached to only one of said suspension risers;

C. a load securement location defined on said suspension risers adjacent said area of confluence thereof being detachably securable to a load for allowing support thereof by said suspension members and said canopy means to facilitate controlled airborne descent thereof;

D. a radar reflective member made of a flexible material having a metallic component to facilitate packing thereof with said canopy means and said suspension members and to facilitate deployment thereof responsive to deployment of said canopy means, said radar reflective member being at least partially radar reflective and attached to said suspension risers and extending therebetween, said enhanced radar reflective member including a plurality of panel members attached with respect to one another and attached to said suspension risers in order to form a radar reflective member with enhanced radar reflective characteristics, said panel member being secured to said suspension risers in a perpendicular angular orientation with respect to one another for enhancing radar reflection therefrom, said panel members defining arcuate panel edges generally in the shape of a partial elliptical curve to facilitate deployment of said panel members extending between said suspension risers responsive to deployment of said canopy means, said radar reflective member being secured to said suspension risers at a position closer to said load securement location and said area of confluence than to said canopy in order to facilitate full deployment of said canopy prior to full deployment of said radar reflective member during deployment of said parachute, said radar reflective member including:

(1) a first panel member secured to oppositely positioned of said suspension risers and extending vertically therebetween;

(2) a second panel member secured to oppositely positioned of said suspension risers and extending vertically therebetween in perpendicular orientation with respect to said first panel member, said first panel member and said second panel member intersecting to form an axis of intersection therebetween with said first panel member and said second panel member extending outwardly from said axis of intersection in perpendicular orientation with respect to each other; and (3) a third panel member extending generally horizontally and perpendicularly with respect to said first panel member and said second panel member, said third panel member being generally circular in shape and attached to said suspension risers for extending approximately horizontally therebetween.

* * * * *